US005133907A

United States Patent [19]

Weber et al.

[11] Patent Number: 5,133,907

[45] Date of Patent: Jul. 28, 1992

[54] LIQUID CIRCULATING DEVICE

[76] Inventors: Leo D. Weber, 345 Parkside Dr., Erie, Pa. 16511; Irwin H. Hess, 12700 Lake Ave., Suite 2712, Lakewood, Ohio 44107

[21] Appl. No.: 686,239

[22] Filed: Apr. 15, 1991

[51] Int. Cl.[5] ..... B01F 3/04

[52] U.S. Cl. ..... 261/153; 261/77

[58] Field of Search ..... 261/77, 153

[56] References Cited

U.S. PATENT DOCUMENTS

| | | | |
|---|---|---|---|
| 3,246,761 | 4/1966 | Bryan et al. | 261/77 |
| 4,169,873 | 10/1979 | Lipert | 261/77 |
| 4,187,263 | 2/1980 | Lipert | 261/77 |
| 4,293,506 | 10/1981 | Lipert | 267/77 |
| 4,356,131 | 10/1982 | Lipert | 261/77 |
| 4,569,757 | 2/1986 | Moore | 261/77 |
| 4,752,421 | 6/1988 | Makino | 261/77 |

*Primary Examiner*—Tim Miles
*Attorney, Agent, or Firm*—George C. Atwell

[57] ABSTRACT

A liquid circulating device is provided for submersion in a large holding tank to effect continuous mixing and circulation of a liquid material, such as sewage sludge, contained therein in order to facilitate the digestion of the liquid material for environmentally safe disposal. The apparatus of the present invention includes an upright, elongated stackpipe secured to the floor of the holding tank and a gas bubble generator mounted to the stackpipe for generating gas bubbles into the stackpipe. The gas bubble generator includes an interior chamber with a substantially open bottom, a pair of baffle members transversely extending within the interior chamber and an inverted cone-shaped member positioned between, and in spaced adjacency to, each baffle member. Gas under pressure is discharged into the interior chamber of the bubble generator by a gas supply line attached to an externally located compressor. A well-formed, stable gas bubble created in the interior chamber of the bubble generator flows down a smooth upper surface portion of each baffle member and into the cone-shaped member which is in flow communication with the stackpipe. The continual generation of well-formed, stable gas bubbles into the stackpipe propels the liquid material upwardly through the stackpipe and effects the circulation, mixing and digestion of the contents. The generation of well-formed, stable gas bubbles is enhanced by mounting the gas bubble generator directly to the stackpipe and not letting the gas bubbles loose between the gas bubble generator and the stackpipe.

18 Claims, 4 Drawing Sheets

LIQUID CIRCULATING DEVICE

BACKGROUND OF THE INVENTION

The device of the present invention relates to the continuous circulation of a large body of liquid material, and more particularly pertains to a liquid circulating device for continuously circulating and mixing sewage sludge thus facilitating the anaerobic digestion of the sludge to effect its safe treatment and disposal.

Over the last one hundred years, collection, treatment, processing, and disposal of human waste has improved immeasurably from the practice of dumping raw sewage in streams, rivers, lakes, and poorly managed, poorly located landfills. Modern sewage treatment facilities include a number of complex steps, procedures and stations for the treatment and disposal of human waste.

The anaerobic digestion of human waste, i.e., substantially liquid sludge, is necessary in the treatment process. In order for anaerobic digestion of the sewage sludge to occur, the sludge must be continuously or batch-fed into large sealed digester or holding tanks, varying in size from 25 to 125 feet in diameter with 15 to 50 foot sidewalls. The size and number of each digester tank is dependent on the city or municipality being served; a 250,000 gallon digester tank is a common size, although holding tanks can range in size from 50,000 gallons to 2,000,000 gallons.

Essential to the circulation, mixing, and anaerobic digestion of the sewage sludge is the placement of some type of open-ended conduit, draft tube, or stackpipe inside the digester tank and submerged within the body of primarily liquid material, such as sewage sludge. In addition, some type of bubble generator is attached to and is in flow communication with the stackpipe. A gas supply line feeding into the bubble generator causes the continual creation of gas bubbles inside the bubble generator. The gas bubbles are then introduced into the stackpipe for propelling the liquid material up through the stackpipe, thus effecting continuous circulation, mixing, and digestion.

The sludge is derived from raw sewage which has been allowed to settle or thicken in other parts of the facility, and then pumped into the digester tank as the feedstock, i.e., the predominantly liquid sewage sludge. The sewage sludge itself contains 92–98% liquid-type material and 2–8% solids and has a thick, soupy consistency. The continuous mixing and circulation of the sewage sludge by the liquid circulating device breaks the sludge down and enables various kinds of microbes to feed upon and digest the sludge. The sludge is actually digested by acid-forming microbes, and the waste material of the acid-forming microbes is eaten by methane-forming microbes, which produce methane as a by-product. One measure of the performance of a digester tank is the amount of methane gas derived from the digestion process: according to specific chemistry formulas used industry-wide, for so many pounds of waste, at a given set of conditions, a proportionate number of pounds of a given substance will be produced.

Concomitant with the continuous or batch feeding of the feedstock into the digester tank, thoroughly digested sludge is being pumped out of the digester tank for further treatment and eventual disposal. Depending on whether the treatment facility serves industrial users or rural users, the treated sludge is deposited in landfills or it can be recycled as fertilizer for farmland.

Representative of prior art liquid circulating devices are the three Lipert patents, U.S. Pat. No. 4,187,263, U.S. Pat. No. 4,293,506 and U.S. Pat. No. 4,356,131. U.S. Pat. No. 4,293,506 is a continuation-in-part of U.S. Pat. No. 4,187,263.

The Lipert U.S. Pat. No. 4,187,263, discloses a verticallyextending, open-ended stackpipe, a large bubble generator adjacent the stackpipe comprising a gas accumulator tank having an open bottom, a peripheral wall, and a top wall. A vertically-extending standpipe is positioned adjacent the bubble generator and the stackpipe, and allows the passage of liquid material therethrough. In addition, a T-pipe extends outwardly from the stackpipe and ends at a flared, downwardly-pointing frusto-conical opening. The open upper end of the standpipe is centered within the flared, frusto-conical opening of the T-pipe.

During operation of the Lipert device '263, gas is delivered into the gas accumulator tank by an inlet pipe. The gas pushes down the liquid sludge in the accumulator tank and also simultaneously lowers the sludge level in a bent pipe attached to, and in flow communication with, the standpipe and the gas accumulator tank. When the sludge reaches a certain predetermined level in the bent pipe and the gas accumulator tank, the gas is siphoned through the bent pipe into the standpipe, up through the transverse T-pipe and then upwardly through the stackpipe as a single large gas bubble. The upward movement of the gas bubble through the stackpipe pushes liquid sludge ahead of the bubble with a piston-like action upward and out the stackpipe upper end. The continual introduction of bubbles into the stackpipe causes the circulation of the liquid sludge through the stackpipe. Thus, the result is the continuous circulation, mixing, and digestion of the digester tank contents.

A number of factors and problems must be considered when designing and installing liquid circulating devices. The lengt of a stackpipe must be related to the volume and depth of the digester tank. A longer stackpipe provides better mixing because the bubble achieves greater momentum in its upward movement through the stackpipe. However, the longer the stackpipe, the more horsepower the compressor will require in order to generate the gas bubbles. Moreover, there is a physical relationship between the depth of the stackpipe and the compressor horsepower needed to generate the gas bubbles: the deeper the point at which the bubble enters the stackpipe, the more horsepower the compressor will require to generate that particular gas bubble.

In addition, the amount of bubbles cycling through the stackpipe at any one time depends on the length of the stackpipe, the depth the stackpipe is placed in the digester tank, and the bubble flow rate into the stackpipe. Each facility will have its own requirements based, in part, on the digester tank volume and the desired turnover rate of the feedstock.

Moreover, there is a trade-off between the gas pressure required to introduce the gas bubbles into the stackpipe and the rate of flow of the feedstock through the stackpipe. If the gas bubble generator is located high on the stackpipe, a lower pressure gas supply can be used, but an inadequate feedstock flow through the stackpipe will occur as well as the creation of malformed bubbles that may not fill the diameter of the stackpipe.

On the other hand, a gas bubble generator placed on the lower portion of the stackpipe will require gas supplied at a higher pressure and a compressor of greater horsepower, but a well-formed bubble will be generated as well as a greater flow rate and a more efficient mixing of the feedstock.

Also, the design of the liquid circulating device must consider the phenomenon known as ragging. Ragging is the term for pieces of fibrous material such as cloth, rags, hair, and fiber balls that clog and plug kitchen and bathroom drains. Ragging occurring in a liquid circulating device will internally clog parts of the device and obstruct the flow of liquid material therethrough, thus impeding the generation of properly formed gas bubbles into the stackpipe.

In the Lipert U.S. Pat. No. 4,187,263, there is a gap between the open upper end of the standpipe and the flared, frusto-conical opening of the transverse T-pipe that extends outwardly from the stackpipe. Ragging that occurs in this gap will impede the flow of gas bubbles or cause the gas bubbles to slip up the side of the stackpipe or down the side of the standpipe. Thus, the continuous circulation of the feedstock will be impeded and the performance of the liquid circulating device will be degraded.

These are some of the factors and problems that must be considered in the design and installation of liquid circulating devices for placement in a digester tank.

SUMMARY OF THE INVENTION

The apparatus of the present invention comprehends a liquid circulating device for submersion in a body of liquid material, such as sewage sludge, for producing a continuous circulation of the liquid material which causes the efficient mixing and digestion of the material.

The liquid circulating device includes an upright, elongated stackpipe and a gas bubble generator adapted for removable mounting to the stackpipe, the gas bubble generator being in flow communication with the stackpipe so that gas bubbles can be continually introduced into the stackpipe by the gas bubble generator. A gas supply means, such as a gas compressor, is located external to the liquid material contained witin a holding tank, ranging in capacity from 50,000 to 2,000,000 gallons, and supplies gas under pressure into the gas bubble generator by a gas supply line. A support means is provided for securing the stackpipe to the floor of the holding tank. Alternatively, the stackpipe can be secured to the covering of the holding tank by a top-mounted support means.

The gas bubble generator includes an interior chamber into which the gas is discharged, the interior chamber also adapted to be fill throughout with the sewage sludge. The gas bubble generator has a substantially open bottom for allowing the sewage sludge to surge through and into the interior chamber completely filling the interior chamber when the gas bubble generator is submerged in the sewage sludge.

The gas bubble generator also includes a pair of oppositely-disposed, baffle members that extend transversely through the interior chamber. Each baffle member includes a smooth, upper rounded portion and a smooth upper surface portion, and further, each baffle member slopes downward and toward the other baffle member. In addition, located between and in spaced adjacency to each baffle member is a generally cone-shaped member which is attached to a vertical back plate of the gas bubble generator. The cone-shaped member has a lower opening and defines an inner vertical cavity which is in flow communication with the stackpipe. Secured to the lower opening is a smooth, rounded, bent, U-shaped bar which facilitates the unimpeded flow of the gas bubble under the bar, through the lower opening, and into and up through the vertical cavity, and thence into the stackpipe.

Mounted on the top plate of the gas bubble generator, and protruding therefrom, is an intermediate nozzle. The nozzle is adapted for removable attachment to a stackpipe opening and is in flow communication with the inner vertical cavity and the stackpipe. In addition, the nozzle is adapted for allowing passage therethrough of the gas bubbles from the vertical cavity of the cone-shaped member into the stackpipe.

It is an objective of the apparatus of the present invention to provide a gas bubble generator that facilitates the flow of gas bubbles into the stackpipe by having smooth, well-rounded structural components that assure minimum resistance to the flow of gas bubbles into the stackpipe by having smooth, well-rounded structural components that assure minimum resistance t the flow of the gas bubbles so that each bubble exits the bubble generator as a single, large well-formed bubble, capable of filling the diameter of the stackpipe.

Another objective of the apparatus of the present invention is to utilize the flow of the liquid to displace the bubble and propel it into the stackpipe. As the gas bubble flows down the smooth upper surface portion of either baffle member, the flow of liquid into the interior chamber of the gas bubble generator is guided in an exponentially contracting path and accelerates slightly as it follows behind the gas bubble, propelling the last of the gas bubble along each smooth upper surface portion so that it stays with the bubble proper.

Yet another objective is to provide a liquid circulating device that has a substantially open bottom which prevents solid material from obstructing the working of the gas bubble generator.

Still another objective of the apparatus of the present invention is to eliminate the phenomenon known as ragging by mounting the gas bubble generator directly to, and in flow communication with, the stackpipe.

A further objective of the apparatus of the present invention is to generate uniform, well-formed, stable, cohesive gas bubbles into the stackpipe, the bubbles filling the diameter of the stackpipe because of the shape and size of the internals i.e., the structural components located within the gas bubble generator.

It is yet another objective of the apparatus of the present invention to provide sufficient surface mixing in order to break up the floatables (grease, scum, etc.) that can accumulate on the surface of the liquid body: such accumulation on the surface forms a scum blanket. The scum blanket prevents the efficient and thorough mixing and digestion of the liquid material; the present invention provides sufficient energy from the gas bubbles and the liquid material exiting the stackpipe to break up the scum blanket and prevent its occurrence.

The various features and advantages of the present invention will become more apparent from the accompanying drawings and the following verbal descriptions of preferred embodiments of the present invention. The descriptions, drawings, and the following examples, are given to merely show preferred examples of the present invention and are not intended to be exclusive of the scope thereof.

DETAILED DESCRIPTION OF THE PREFERRED EMBODIMENT

As illustrated in FIGS. 1 through 4, a preferred embodiment is shown of a liquid circulating device 10 for placement within a large holding or digester tank filled with a body of predominantly liquid material 12. The liquid circulating device 10 of the present invention is adapted for processing the liquid material 12, such as sewage sludge, for environmentally safe disposal. In addition, the liquid circulating device 10 is designed to generate a continuous circulation of the liquid material 12 in order to thoroughly mix and digest the material 12. Also, the apparatus of the present invention is adapted for submersible placement in a holding or digester tank containing sewage sludge in order to facilitate the anaerobic digestion of the content contained within the tank. The liquid circulating device 10, in effect, works as a physical pump or a draft tube. The continuous circulation of the liquid material 12 causes the destruction of volatile solids, thus mixing the material 12 and breaking it down so that various types of microbes living in the liquid material 12 can feed upon and consequently digest the material 12. Various types of gases, such as methane gas, are by-products of the process of anaerobic digestion.

Figure 1:
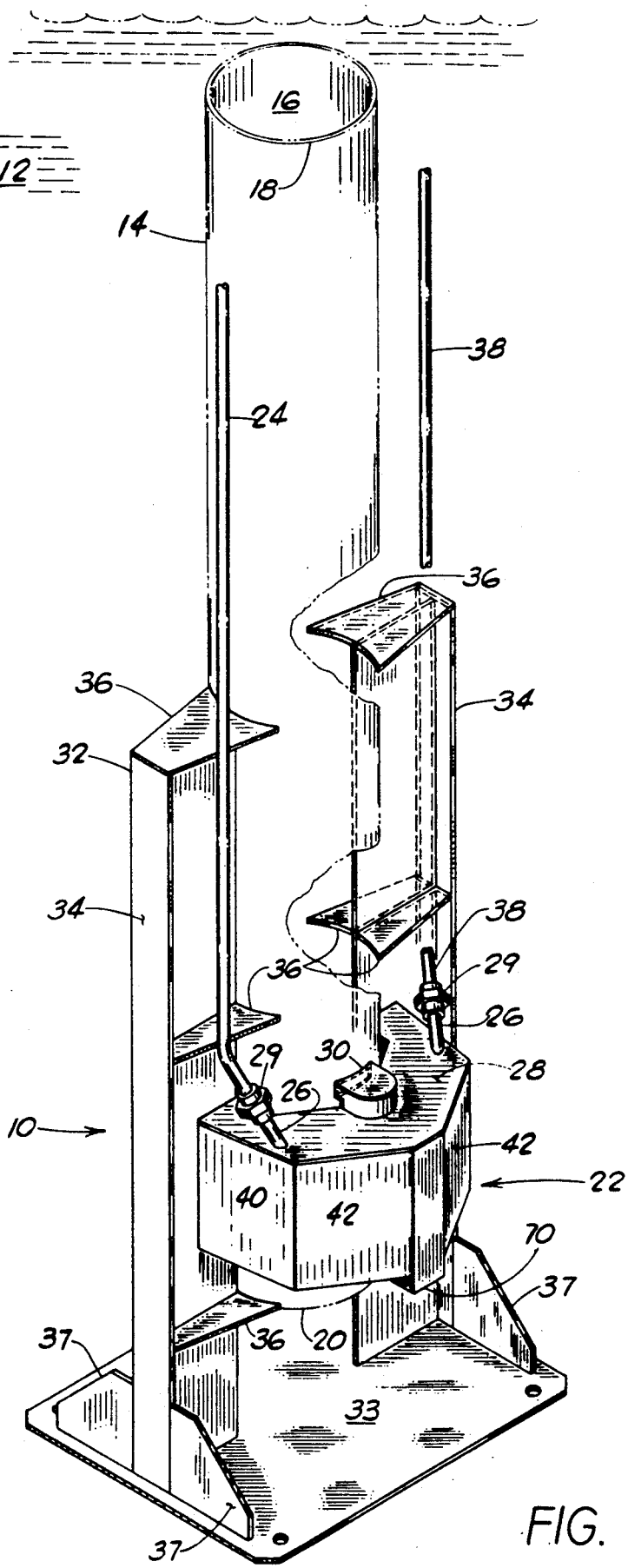
FIG. 1 is an isometric view of the liquid circulating device of the present invention, illustrating the stackpipe, the bubble generator, and other structural components.
Figure 4:
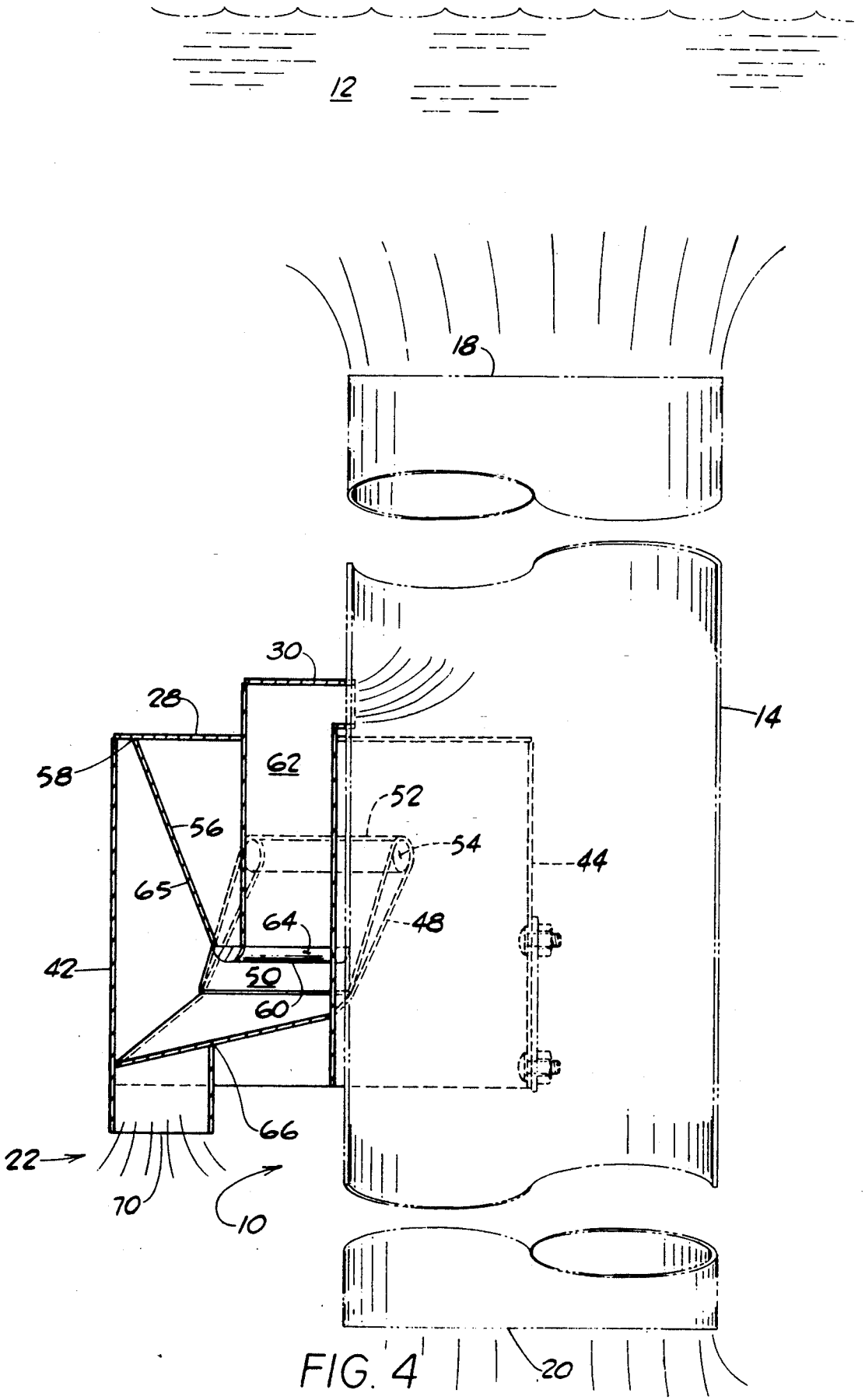
FIG. 4 is a sectional elevational view of the liquid circulating device taken along lines 4—4 of FIG. 3.

Referring to FIGS. 1 and 4, the liquid circulating device 10 includes a vertically elongated, cylindrical, upright stackpipe 14, which is submersibly placed in the holding tank. The cylindrical stackpipe 14 may have a height of up to 65 feet and is constructed of a durable steel material. In order to better resist corrosion due to the chemical reactions that occur in the sewage sludge, the stackpipe 14 may be composed of two percent bronze. Throughout the vertical length of the stackpipe 14 there is defined a hollow stackpipe passageway 16 which terminates at an upper open egress end 18 and at an oppositely-disposed lower open ingress end 20. As will be more fully explained hereinafter, the material 12 flows into the hollow passageway 16 of the stackpipe 14 through the ingress end 20, and exits the passageway 16 of the stackpipe 14 through the egress end 18. Although not shown in any of the figures, the stackpipe 14 also includes an opening located on the side of the stackpipe 14.

Figure 3:
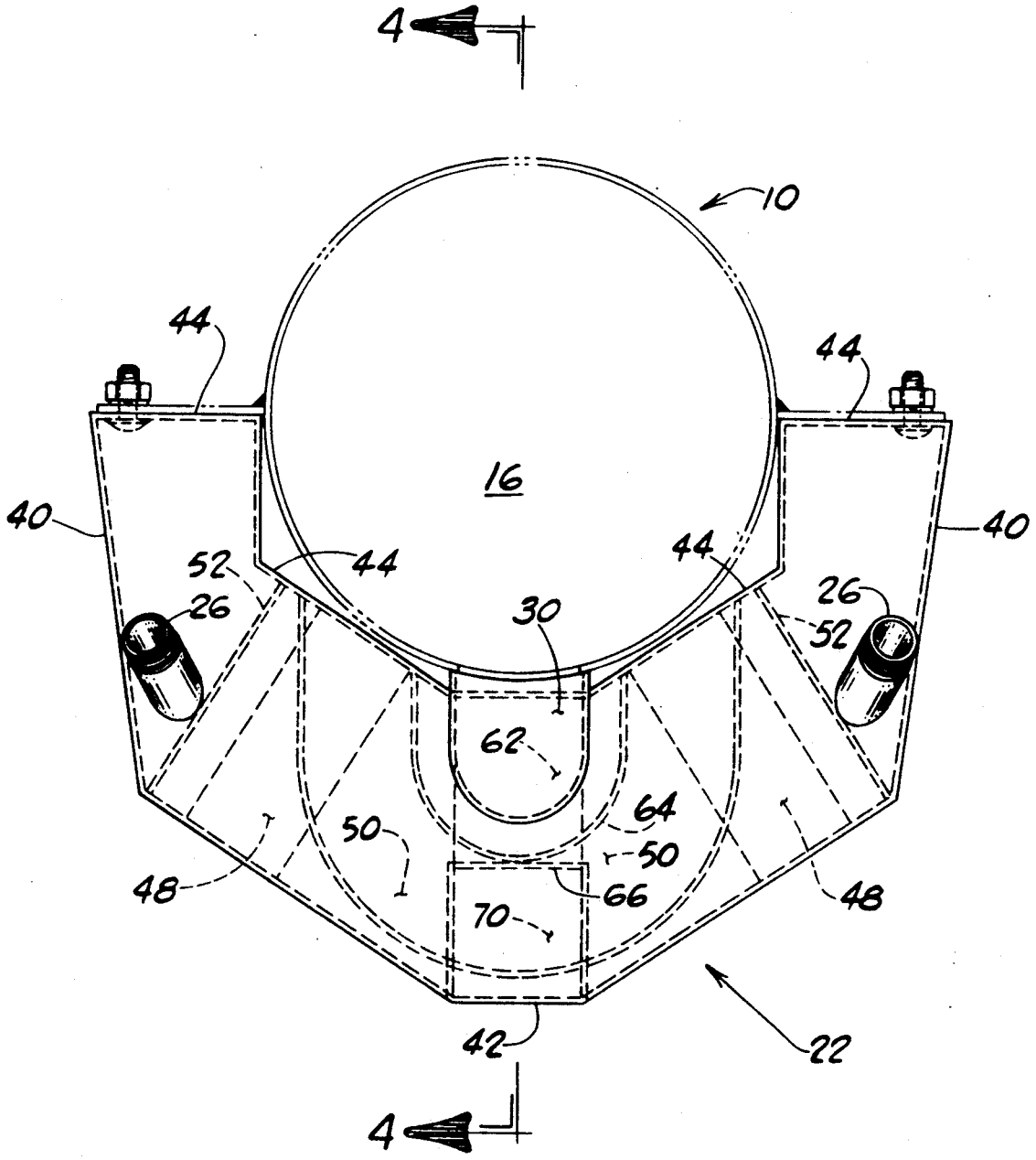
FIG. 3 is a top plan view of the liquid circulating device first shown in FIG. 1.

The liquid circulating device 10 includes a gas bubble generator 22 which is secured or mounted to the side of the stackpipe 14 and is in flo communication with the stackpipe opening and the stackpipe passageway 16. The gas bubble generator 22 is adapted to be removably securable to the side of the stackpipe 14. The gas bubble generator 22 may be described as generally polyhedron-shaped; FIG. 3 illustrates how the gas bubble generator 22 is designed to partially conform to the cylindrical stackpipe when the bubble generator 22 is mounted thereto.

The primary structural component of the liquid circulating device 10 is the gas bubble generator 22, which is adapted for continually generating gas bubbles and introducing the gas bubbles into the passageway 16. Once the gas bubbles are introduced into the passageway 16, their upward momentum causes the liquid material 12 above the bubbles to be propelled up through the stackpipe 14. The bubble generator 22 is adapted to continually introduce gas bubbles into the passageway 16 of the stackpipe 14, thus causing the continuous circulation and mixing of the sewage sludge contained within the holding tank.

Located external to the holding tank is a gas supply means, such as the gas compressor (not shown), for supplying gas at a pre-determined pressure to the gas bubble generator 22. The compressors are rated in SCFM (14.7 psi and 60° F.), and the size of the compressor is dependent upon such factors as the volume of liquid material in the holding tank, the turnover rate of the liquid material as desired by plant specifications, and the depth at which the bubble generator is mounted to the stackpipe 14. Furthermore, the pressure is also determined by the hydrostatic head of the liquid 12 above the bubble generator 22. The gas volume is inversely proportional to the absolute pressure. For example, for a bubble generator located 34 feet below the surface of the liquid material the gas volume flow rate (ACFM) will be one-half the SCFM. At 20 feet below the surface the ACFM will be 34/(34+20) or 0.63 of cubic feet per minute for each SCFM delivered by the compressor. As illustrated in FIG. 1, the gas, such as methane gas, is discharged through a gas supply line 24 which extends down into the holding tank and is attached to a connection member, the connection member in turn is attached to, and in flow communication with, the gas bubble generator 22.

Figure 2:
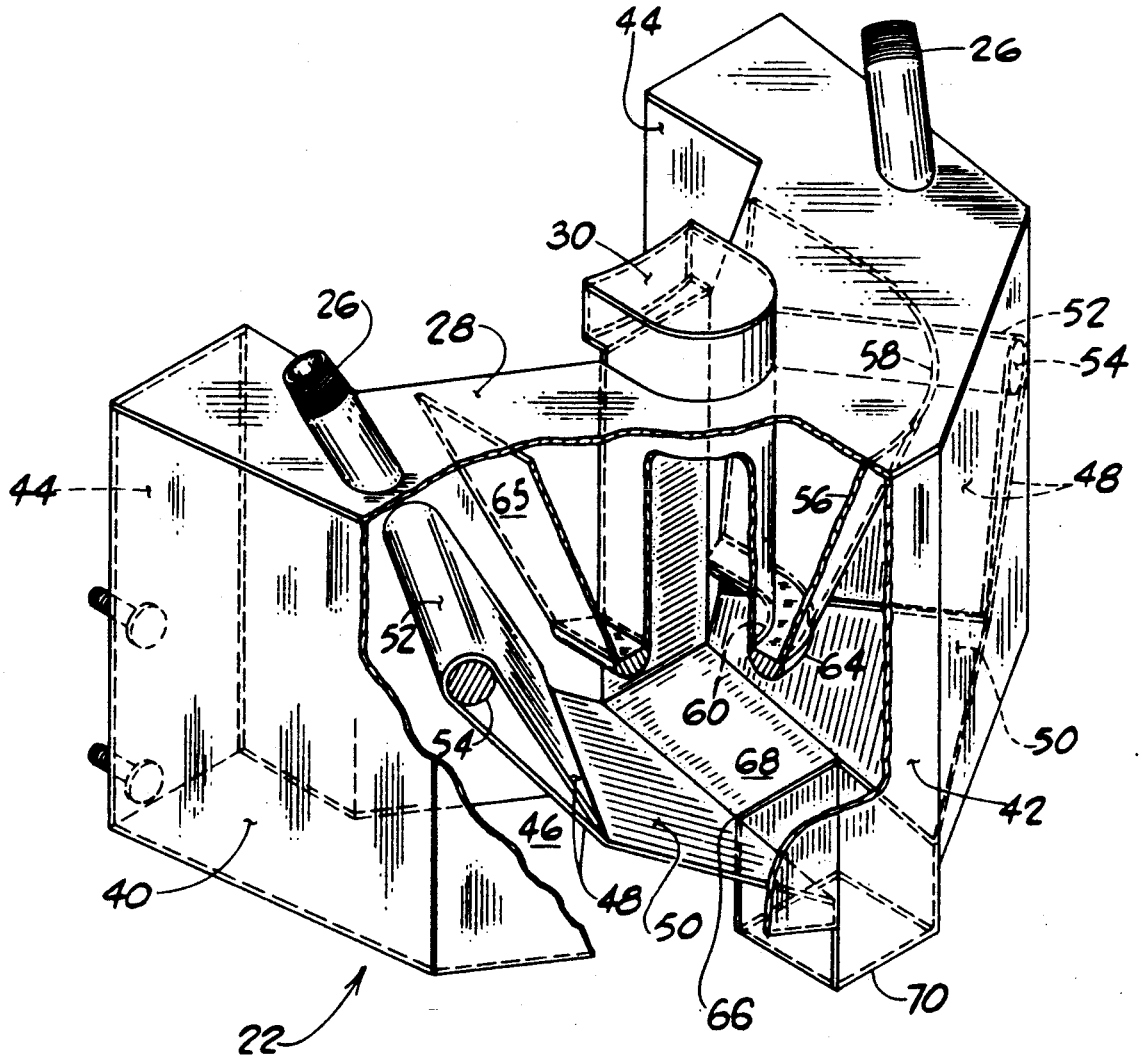
FIG. 2 is an enlarged isometric view of the bubble generator first shown in FIG. 1, with a portion of the bubble generator cut away to reveal internal structural components.

As shown in FIGS. 1, 2, and 3, the apparatus of the present invention includes two gas supply line connection members 26. More specifically, each gas supply line connection member 26 is secured to a flat top plate 28 of the bubble generator 22 at an angle of 60° with respect to the flat top plate 28. The gas supply line 24 is attached to, and in flow communication with, one of the gas supply line connection members 26 and each gas supply line connection member 26 is in flow communication with the bubble generator 22, as shall be more fully described hereinafter. A threaded coupling 29 may be used to attach the gas supply line 4 to the connection member 26. An intermediate nozzle 30 mounted on the top plate 28 of the bubble generator 22 is adapted for sealable attachment to the stackpipe opening. The nozzle 30 allows passage therethrough of the gas bubbles and the sewage sludge from the bubble generator 22 through the stackpipe opening and into the stackpipe passageway 16.

A support means is necessary for securing the stackpipe 4 to the floor of the holding tank. The support means may be for either top supporting or bottom supporting; in the apparatus of the present invention the stackpipe 14 is bottom supported. The support means for the liquid circulating device 10 includes a pair of oppositely disposed, upright column supports 32 secured to the stackpipe 14, and a base plate 33 adapted for removable securement to the floor of the holding tank, with one column support 32 secured to one side of the stackpipe, and the other column support 32 secured 180° to the opposite side of the upright stackpipe 14. Each column support 32 includes a vertically extending upright member 34 which is spaced from the stackpipe 14 and a plurality of spaced-apart, flat horizontal plates having a first plate end attached to each upright member and a second plate end attached to the side of the stackpipe 14. Each plate 36 is comprised of two half portions as shown in FIG. 1. The lowest horizontal plate 36 is attached to the tackpipe 14 parallel to the lower end 20 and the topmost horizontal plate 36 may be attached at a point generally halfway up the stackpipe 14, the topmost plate 36 also defining the top of each column support 32. The gas bubble generator 22 is mounted to the side of the stackpipe 14 adjacent each colum support. In addition, each column support 32 may include a vertically-extending web member which extends the height of each column support 32 and is located between each half portion of each horizontal plate 36. A pair of generally triangular-shaped gusset plates 37 are attached to each upright member 34 and having a horizontal edge contiguous to the base plate 33.

A rodding line 38, as shown in FIG. 1, may also be included with the liquid circulating device 10. If the rodding line 38 is included, it would be secured to either of the gas supply line connection members 26, and in flow communication with the bubble generator 22. The rodding line 38 has a first end (not shown) which can be attached to an externally located compressor and a second end which would be attached to either of the gas supply line connection members 26. The rodding line 38 would extend adjacently therealong the stackpipe 14, and could be attached to the stackpipe 14 in several different ways (not shown). The rodding line 38 would be used to blow out and remove pluggage from the bubble generator 22, and would be manufactured from, for example, a two-inch diameter stainless steel pipe. The rodding line 38 removes pluggage by introducing a substance under high pressure, such as water or steam, into the bubble generator 22. Pluggage occurs due to a phenomenon known as ragging: the accumulation of fibrous materials (hair and fiber balls of the kind that clog ordinary household sinks and drains) inside the bubble generator 22.

In addition, the apparatus of the present invention could include a heating jacket (not shown in any of the figures) which would be adapted for removable placement around the stackpipe 14, generally above the bubble generator 22 and the column supports 32. The purpose of the heating jacket would be to sustain the various types of microbes at a constant temperature of generally between 92 and 96 degrees in the liquid material 12, and especially in the liquid material 12 circulating through the stackpipe 14. The heating jacket may include a split, two-pass pipe that conducts heat to the liquid material in the stackpipe 14 so that the aforestated temperature range can be maintained as the optimum temperature within which the microbes can flourish.

As illustrated in FIGS. 1 through 4, the primary structural component of the apparatus of the present invention is the bubble generator 22. The bubble generator 22 includes a number of structural features which facilitate the creation of stable, well-formed, cohesive bubbles which exhibit a high degree of integrity for introduction into the passageway 16 of the stackpipe 14, the gas bubbles being generally uniform in size and filling the diameter of the stackpipe 14. In order to generate optimum flow of the liquid material 12 through the stackpipe 14, the bubble generator 22 should be mounted near the bottom quarter of the stackpipe 14. The further up on the stackpipe 14 that the bubble generator 22 is mounted, the more likelihood there is of the generation of malformed bubbles. Such bubbles will be unable to fill the stackpipe diameter to provide sufficient upward momentum to produce adequate flow of the liquid material 12 through the passageway 16 of the stackpipe 14. However, the lower down on the stackpipe 14 the bubble generator 22 is mounted, the more momentum the bubble will have as it flows upward through the passageway 16 of the stackpipe 14. Consequently, a greater flow of the liquid material 12 through the stackpipe 14, and a more efficient mixing of the contents, i.e., the sewage sludge, will result. But the deeper or lower on the stackpipe 14 the bubble generator 22 is mounted, the more horsepower the compressor will require and the higher the energy generating costs will be.

As shown in FIGS. 1, 2, and 4, the gas bubble generator 22 includes the flat top plate 28, a pair of oppositely disposed vertical sidewalls 40 that are contiguously attached at their respective top sidewall edges to one of the peripheral edges the top plate 28 and a face plate 42 which can be adapted for either permanent or contiguous removable securement to the bubble generator 22 along a forwardly facing vertical edge of each vertical sidewall 40 and along a forward edge of the top plate 28. Each gas supply line connection member 26 is attached to the top plate 28 adjacent one of the peripheral edges of the top plate 28. Furthermore, each gas supply line connection member 26 is attached to the top plate 28 at an angle, 60° being one preferred angle, for discharging the gas into the bubble generator 22. A vertically-extending back plate 44 shaped to partially encompass the stackpipe 14, as illustrated in FIG. 3, is attached to a rear horizontal edge of the top plate 28 and a rearwardly facing vertical edge of each sidewall 40. When the bubble generator 22 is mounted to the stackpipe 14, the back plate 44 is positioned adjacent to, and partially contacts, the stackpipe 14.

The gas bubble generator 22 further defines an interior chamber 46, as shown in FIG. 2, which has a substantially rectangular, vertical cross sectional area, the interior chamber 46 being enclosed by the top plate 28, each vertical sidewall 40, face plate 42 and the back plate 44, i.e., te entire area or region within the generator 22 defines and encloses the interior chamber 46. When the bubble generator 22 is disposed in its operative position of being mounted to the stackpipe 14 in the body of the liquid material 12 contained within the holding tank, the interior chamber 46 is filled throughout by the liquid material 12. In addition, the interior chamber 46 receives the pressurized gas as the gas is discharged and introduced therein from one of the gas supply line connection members 26.

As shown in FIGS. 2, 3, and 4, the bubble generator 22 also includes a pair of spaced-apart, oppositely-disposed, angled baffle members that are secured to, and extend tranversely through the interior chamber 46 from the back plate 44 to the face plate 42 with each baffle member 48 sloping downward toward the other baffle member 48. Each baffle member 48 has a 60° slope and includes a smooth surface portion 50 which facilitates the unimpeded flow of the liquid material 12 and the gas bubbles therealong and into the stackpipe 14, as will be more fully described hereinafter. In addition, each baffle member 48 includes a transversely extending, upper rounded portion 52 that is also adapted to facilitate the smooth flowing movement of the gas bubble over each respective rounded portion 52 and downward along each upper surface portion 50. Each upper rounded portion 52 is contiguous to each respective smooth surface portion 50. The angle of the connection member 26 and the baffle members 48 are shown by way of example only; depending on such factors as the fluid viscosity and bubble rate generation, these angles can be changed. The angles of the connection member 26 and baffle members 48 are congruent so that the bubble strikes the baffle member 48 as it is ejected from the connection member 26 and flows downwardly on the baffle member 48.

The baffle members 48 may be constructed from a unitary piece of rolled steel material, as shown in FIGS. 2, 3, and 4, and each upper rounded portion 52 is integrally formed therefrom. Each baffle member 48 overlaps and is wrapped around a cylindrical bar 54 that extends transversely through the interior chamber 4 and is attached to the back plate 44 and the face plate 42, and each cylindrical bar 54 is contiguous to an inner curved surface of each upper rounded portion 52. The cylindrical bars 54 provide stability and support for the upper rounded portion 52 of each baffle member 48. Furthermore, as shall be more fully described hereinafter, the baffle members 48 can be variously positioned within the bubble generator 22 to provide maximum acceleration of the liquid material 12 as it flows downwardly along the upper surface portion 50 following behind the gas,bubbles.

As illustrated in FIGS. 2 through 4, attached to the back plate 44 and the top plate 28, and projecting into the interior chamber 46, is an angled, generally cone-shaped member 56. The cone-shaped member 56 includes a half circle, upper rounded peripheral edge 58 which is contiguous to the top plate 28 and adjacent to the face plate 42. The cone-shaped member 56 includes a generally U-shaped lower opening 60 and an inner elongated vertical cavity 62. The inner elongated vertical cavity 62 is in flow communication with the nozzle 30 that is mounted on the top plate 28, and is also in flow communication with the interior chamber 46.

As illustrated in FIG. 2, each baffle member 48 is located to either side of, and in spaced adjacency to, the coneshaped member 56, and each upper surface portion 50 of each baffle member 48 extends downwardly adjacent along the side and part ally beneath the cone-shaped member 56. A half-rounded, substantially U-shaped bar 64 is attached to, and adapted to conform with, the lower opening 60 of the cone-shaped member 56. The U-shaped bar 4 has a smooth surface which is adapted to facilitate the smooth, unimpeded flow of liquid material and gas bubbles thereunder and into the vertical cavity 62. The cone-shaped member 56 receives gas bubbles and liquid material through the lower opening 60 and thence into the vertical cavity 62 whereupon the liquid material and the gas bubbles flow through the nozzle 30 and into the passageway 16 of the stackpipe 14. The smooth, well-rounded U-shaped bar 64 assures minimum resistance to the gas bubbles as they leave the interior chamber of the bubble generator 22, and, thus, each bubble leaves the generator 22 as a single, large well-formed bubble. In addition, the rounded portion 52 prevents the ejected gas bubble and liquid material 12 from hanging up and clogging the generator 22 by its smooth, rounded surface.

Furthermore, the inner vertical cavity 62 of the cone-shaped member 56 defines a vertical axis which is parallel to the vertical axis defined by the passageway 16 of the stackpipe 14. The cone-shaped member 56 also includes a downwardly and inwardly sloping smooth exterior surface 65, as illustrated in FIG. 4, which encloses the inner vertical cavity 62 and is disposed at an angle of between 20 degrees and 70 degrees with respect to the vertical axis of the vertical cavity 62. The aforestated range for the slope of the exterior surface 65 has been found to best facilitate the smooth and rapid discharge of the gas bubbles into the passageway 16 of the stackpipe 14. In addition, the exterior surface 65 also facilitates the rapid and smooth flowing movement of the gas bubbles as they flow down the surface portion 50 of the baffle members 48, the distance between each baffle member 48 and the adjacent portion of the exterior surface 65 of the cone-shaped member 56 assisting in forming or shaping the gas bubbles by restricting the area of travel for the gas bubbles. The distance between each surface portion 50 and the exterior surface of the cone-shaped member 56 also facilitates the formation of gas bubbles exhibiting a high degree of integrity (cohesion).

As illustrated in FIGS. 2, 3 and 4, the preferred embodiment of the apparatus of the present invention includes a rectangular-shaped tail member 66 which is located generally beneath the cone-shaped member 56 and between each baffle member 48. The tail member 66 extends from the back plate 44 to the face plate 42. The lowest portion of each surface portion 50 of each baffle member 48 abuts and terminates at the tail member 66. The tail member 66 includes a downwardly sloping flat member 68 disposed adjacent and beneath the lower opening 60 and the U-shaped bar 64 of the cone-shaped member 56, and a square-shaped vertically extending member 70 which is adapted for allowing the passage of liquid material into the interior chamber 46 and the cone-shaped member 56, and is located between the flat member 68 and the face plate 42. More specifically, the lowest portion of each smooth surface 50 is attached to the downwardly sloping flat member 68 and the sides of the square-shaped member 70. As illustrated in FIGS. 2 and 3, a smooth contiguous surface is formed starting from the upper rounded portion 56 of the baffle member 48 on the lefthand side, continuing down along the smooth surface portion 50 to the sloping flat member 68, thence along and up the surface portion 50 of the baffle member 48 on the righthand side, and finally to the upper rounded portion 52. The flat member 68 is located generally underneath and adjacent to the lower opening 60 of the cone-shaped member 56 and slopes downward from the back plate 44 toward the face plate 42.

In operation, the liquid circulating device 10 is submersibly placed in the holding tank filled with the liquid material 12 such as sewage sludge. The number of liquid circulating devices placed within the holding tank are dependent on such factors as the desired turnover rate for the sewage sludge and the circulation that is required for that particular turnover rate. The externally located compressor discharges gas, such as methane gas, at a pre-determined pressure through the gas supply line 24 and the respective gas supply line connection member 26 and into the interior chamber 46 of the bubble generator 22 whereupon the gas enters as a continual stream of gas bubbles. The substantially open bottom of the bubble generator 22 allows the liquid material 12 to suffuse the interior chamber 46. As the gas enters the chamber 46 the gas pushes down the liquid material 12 within the interior chamber 46 and the gas starts to flow down the surface portion 50 of one of the baffle members 48. The gas will get larger because, as the pressure goes down in the interior chamber 46, according to the formula PV/T, the area in which the gas bubble can expand increases.

When the gas pushes the liquid material 12 to a point immediately below the U-shaped bar 64, the gas is rapidly siphoned out through the inner vertical cavity 62 and the nozzle 30, and into the passageway 16 of the stackpipe 14 as a large, stable, cohesive gas bubble. As this is occurring, liquid material 12 is flowing up through and filling the interior chamber 46. At the same time, lqiuid material 12 beneath the lower opening 60 egresses through the square-shaped member 70 at a low rate due to the downward flow of gas toward the lower opening 60, and also in part due to the liquid material 12 flowing into and refilling the interior chamber. The liquid material 12 following the gas actually accelerates as it flows smoothly in an exponentially contracting path over the upper rounded portion 52, downwardly along the surface portion 50 and under the smooth U-shaped bar 64 of the cone-shaped member 56, and assists in pushing the last of the gas along so that it stays with the gas bubble proper. The surface portion 50 provides less friction resistance to the gas as it flows therealong and, therefore, the gas travels in a smooth, flowing movement. When the liquid material 12 has been pushed down by the gas to the point immediately below the lower opening 60 and the U-shaped bar 64, the gas breaks over the smooth rounded edge of the U-shaped bar 64 and is rapidly s phoned out of the interior chamber 46 and up through the inner vertical cavity 62 of the cone-shaped member 56. As the gas flows down the baffle member 48, liquid material 12 is displaced downward and out the square-shaped member 70. The surface tension between the gas bubble and the surrounding liquid material 12 helps to maintain the stable and cohesive form of the gas bubble as it travels up the vertical cavity 62, through the nozzle 30 and into the passageway 16 of the stackpipe 14.

Depending on the desired pumping rate for generating circulation through the stackpipe 14, gas bubbles can be introduced into the passageway 16 of the stackpipe 14 each second to every three seconds. The volume of the liquid material 12 that is above the lower opening 60 of the cone-shaped member 56 divided by the actual gas rate (ACFM) represents the gas bubble time rate. For example, if the gas rate is 30 ACFM and the gas bubble generator 22 of the present invention has a volume of 1.2 cubic feet then a gas bubble will release every 1.2/30 minutes or 2.4 seconds.

The square-shaped member 70 restricts the flow of the liquid material 12 upward into the interior chamber 46, but also assists in pushing the gas bubbles u through the inner vertical cavity 62. As the gas bubble rises upward in the cavity 62, liquid material 12 re-enters the member 70. The upward flow of lqiuid material 12 is restricted by the small cross-sectional area of the member 70 and the length of the member 70. The member 70 acts like a nozzle which provides some pressure drop. Liquid material 12 follows the gas bubble up through the cavity 62 until the bubble is discharged in the passageway 16. For an instant the entire system is at equilibrium and then incoming gas continues the process. At least one gas bubble is moving upward in the passageway 16 at any given time, and the gas bubble generated will fill the diameter of the stackpipe 16.

The bubble generator 22 of the present invention is designed to avoid the phenomenon known as motoring which is the creation of a continuous stream of small bubbles which enter the passageway 16 of the stackpipe 14 but do not completely fill the diameter of the stackpipe 14, and, moreover, are unstable, poorly formed gas bubbles which are unable to propel the liquid material 12 up through the stackpipe 14 to effect proper mixing and circulation. Motoring is also caused by a too rapid fillup in the bubble generator 22 of gas bubbles. The aforedescribed internal structural components of the bubble generator 22 of the present invention enhance the creation of a continual stream of stable, cohesive, well-formed gas bubbles.

In addition, another advantage of the bubble generator 22 of the present invention is that it avoids letting gas bubbles loose in the interior chamber 46. As the gas is discharged and introduced into the interior chamber 46 the smooth upper rounded portion 52 and the smooth surface portion 50 of each baffle member 48 directs the movement of the gas bubbles therealong and towards the lower opening 60 of the cone-shaped member 56. Thus, the shape of internal structural components of the bubble generator 22 and the flow of liquid material 12 following behind the gas bubbles maintains the cohesion of the gas bubbles and directs them through the lower opening 60 and up into the vertical cavity 62 of the cone-shaped member 56.

This is in contrast to the structure of other types of bubble generators which by their design, for example, permit the gas bubble to slip up the side of the stackpipe. Once the gas bubble created by the bubble generator 22 of the present invention enters the stackpipe passageway 16 it is shaped by the liquid material on top of it. The gas bubble formed by the bubble generator 22 of the present invention forms a stable meniscus which propels the liquid material 12 on top of it up through the stackpipe 14 thus affecting the efficient and continuous mixing and circulation of the liquid material 12. As the well-formed gas bubble propels the liquid material 12 up through the stackpipe 14, a vacuum is created between the upwardly moving gas bubble and the liquid material 12 beneath it in the stackpipe 14. However, the downward pressure from the surrounding liquid material 12 in the holding tank causes this area to be immediately filled by liquid material 12 entering through the lower open ingress end 20; the liquid material 12 generally drawn from a sphere of influence between roughly 10 feet to 15 feet in circumference from the lower end 20 of the stackpipe 14.

When immersibly placing the stackpipe 14 with the bubble generator 22 mounted thereto in the holding tank, several other factors must be taken into account. Since there may be six inches of silt on the floor of the digester tank, the lower end 20 must be a sufficient distance above the floor to insure the proper, continuous and unimpeded flow of liquid material 12 into the lower end 20. In the apparatus of the present invention the stackpipe 14 is located so that the lower end 20 is above the floor of the holding tank a distance equal to at least one diameter of the stackpipe 14. Therefore, the height above the floor of the digester tank should be at least equal to the stackpipe diameter plus six inches.

Another factor to be considered when immersibly placing the stackpipe 14 in the liquid material 12 is the necessity for getting a proper surface mix. If the surface mixing of the liquid material 12 is inadequate, a build up or scum blanket will form on the surface of the liquid material 12 within the holding tank, the build up consisting of a large cake of accumulated grease and scum, which are referred to in the industry as floatables. A relatively violent agitation of the body of the liquid material 12 is required in order to break up the scum blanket consisting of the floatables in order to prevent the various types of microbes from simply eating off the bottom of the large cake and never completely digesting the contents of the scum blanket.

The scum blanket may be up to two or three feet thick and cover the entire surface of the body of liquid material 12. In order to break this up, the continual stream of gas bubbles exiting the upper egress end 18 of the stackpipe 14 should have enough pressure to strike and break up the scum blanket, i.e., the floatables. The kinetic energy of the liquid material 12 and the gas bubbles leaving the passageway 16 of the stackpipe 14 dissipates when it reaches the surface of the material 12 and is transferred to the scum blanket, thereby breaking it up. Therefore, in the liquid circulating device 10 of the present invention, the stackpipe 14 is placed within the liquid material 12 so that the upper egress end 18 is located below the surface of the liquid material 12 a distance at least equal to the diameter of the stackpipe 14 to assure that the kinetic energy is transferred to the scum blanket in order to break it up. If the upper egress end 18 of the stackpipe 14 is located too close to the surface of the liquid material 12, the kinetic energy will dissipate by pushing the liquid material 12 above the surface. If the upper egress end 18 is located too far away from the surface of the liquid material 12, the kinetic energy of the gas bubbles and the liquid material 12 will be insufficient to break up the scum blanket. Thus, by locating the upper egress end 18 in the aforedescribed position, the gas bubbles and the liquid material 12 will exit the upper egress end 18 of the stackpipe of the present invention with enough pressure to break up the scum blanket.

While there have been described and illustrated preferred embodiments of the present invention it is apparent that numerous omissions, additions and alterations may be made without departing from the spirit thereof.

We claim:

1. A liquid circulating device for submersible placement in a holding tank containing a body of substantially liquid material, for generating a continuous circulation of the liquid material, the liquid circulating device comprising:

a vertically elongated stackpipe having a hollow passageway that terminates at an upper open egress end and an oppositely-disposed lower open ingress end, the passageway adapted for allowing the flow of the liquid material therethrough;

a gas bubble generator secured to the stackpipe and in flow communication with the passageway of the stackpipe, the gas bubble generator adapted for generating gas bubbles and introducing the gas bubbles into the passageway of the stackpipe in order to propel the liquid material up through the stackpipe;

the gas bubble generator further comprising a flat top plate, a pair of oppositely-disposed, vertical sidewalls attached to the flat top plate, a face plate adapted for contiguous securement to each vertical sidewall and the flat top plate, a back plate attached to the top plate and each vertical sidewall, and a substantially open bottom for allowing liquid material to enter therethrough;

a cone-shaped member attached to the back plate and the top plate and having a rounded peripheral edge adjacent the face plate, the cone-shaped member in flow communication with the passageway of the stackpipe for allowing flow therethrough of the liquid material and the gas bubbles;

a pair of oppositely-disposed, spaced-apart, angled baffle members secured to and extending transversely from the back plate to the face plate with each baffle member sloping downward toward the other baffle member, the baffle members located in spaced adjacency to the cone-shaped member and each baffle member including a smooth surface portion for facilitating the unimpeded flow of gas bubbles and liquid material therealong and toward the cone-shaped member;

a gas supply means for discharging gas under pressure to the gas bubble generator; and a support means for securing the stackpipe to the floor of the holding tank.

2. The apparatus of claim 1 wherein the gas bubble generator is adapted for removable securement to the stackpipe.

3. The apparatus of claim 1 wherein the face plate is adapted for removable securement to each sidewall and the top plate of the gas bubble generator.

4. The apparatus of claim 1 wherein the lower open ingress end of the stackpipe is located above the floor of the holding tank a distance equal to at least one diameter of the stackpipe.

5. The apparatus of claim 1 wherein the upper open egress end of the stackpipe is located below the surface of the liquid material a distance at least equal to the diameter of the

6. The apparatus of claim 1 wherein the gas bubble generator includes an interior chamber enclosed by the top plate, each vertical sidewall, the face plate, and the back plate, the interior chamber adapted to fill throughout with the liquid material and receive the gas discharged by the gas supply means.

7. The apparatus of claim 6 further comprising at least one gas supply line connection member attached to the flat top plate and adapted for discharging into the interior chamber gas under pressure from the gas supply means.

8. The apparatus of claim 7 further comprising a rectangular-shaped tail member located between each baffle member and having a downwardly-sloping flat member disposed adjacent and beneath the lower opening of the cone-shaped member and a square-shaped member located between the flat member and the face plate, the square-shaped member adapted to allow passage of the liquid material upward therethrough into the interior chamber and the cone-shaped member.

9. The apparatus of claim 8 wherein the cone-shaped member includes a lower opening adjacent each smooth upper surface portion, the lower opening adapted to allow flow therethrough of the liquid material and the gas bubbles.

10. The apparatus of claim 9 wherein the cone-shaped member includes an elongated inner vertical cavity in flow communication with the interior chamber and the passageway of the stackpipe, the inner vertical cavity having a vertical axis parallel to the vertical axis of the stackpipe and adapted to allow flow therethrough by the gas bubbles and the liquid material.

11. The apparatus of claim 10 wherein the cone-shaped member includes a half-rounded, substantially U-shaped bar attached at the lower opening of the cone-shaped member, the U-shaped bar adapted to conform to the lower opening and to facilitate the unimpeded flow of the gas bubbles into the inner vertical cavity.

12. The apparatus of claim 11 wherein the cone-shaped member includes a downwardly and inwardly sloping exterior surface, having a slope of between 20° and 70° with respect to the vertical axis of the inner vertical cavity.

13. The apparatus of claim 12 further comprising a nozzle mounted on the top plate and adjacent to the back plate, the nozzle in flow communication with the inner vertical cavity and the passageway of the stackpipe, and adapted for attachment to stackpipe for allowing passage therethrough of the gas bubbles and the liquid material.

14. The apparatus of claim 1 wherein each baffle member includes a transversely-extending, rounded portion contiguous to each smooth upper surface portion, each rounded portion adapted to facilitate the smooth flowing movement of the gas bubbles thereover and downward therealong each smooth surface portion.

15. The apparatus of claim 1 wherein the support means includes a generally square-shaped base plate disposed for removable securement to the bottom of the holding tank.

16. The apparatus of claim 15 further comprising pair of oppositely-disposed upright colomn supports secured to the stackpipe and extending at least halfway up the stackpipe. each column support also secured to the base plate and adapted to uprightly maintain the stackpipe submerged in the liquid material within the holding tank.

17. The apparatus of claim 16 wherein each column support includes a vertically-extending upright member spaced from the stackpipe and a plurality of spaced-apart, flat horizontal plates having a first plate end attached to the upright member and a second plate end attached to the stackpipe.

18. The apparatus of claim 17 further comprising a pair of generally triangular-shaped gusset plates attached to each upright member of each column support, each gusset plate having a horizontal edge that is contiguous to the base plate.

* * * * *